US005784767A

United States Patent [19]

Doty, Jr.

[11] Patent Number: 5,784,767

[45] Date of Patent: Jul. 28, 1998

[54] SELF-ALIGNING SEAT BELT BUCKLE

[76] Inventor: Archibald C. Doty, Jr., 347 Jackson Rd., Fletcher, N.C. 28732

[21] Appl. No.: 806,838

[22] Filed: Feb. 24, 1997

[51] Int. Cl.[6] ..... A44B 11/26

[52] U.S. Cl. ..... 24/665

[58] Field of Search ..... 24/662, 633, 651, 24/664, 665, 672, 640

[56] References Cited

U.S. PATENT DOCUMENTS

| | | | |
|---|---|---|---|
| 231,048 | 8/1880 | Ives . | |
| 813,838 | 2/1906 | Steinberg . | |
| 2,542,044 | 2/1951 | Miller et al. . | |
| 3,102,317 | 9/1963 | Cadley . | |
| 3,237,258 | 3/1966 | Fisher . | |
| 3,242,546 | 3/1966 | Fisher . | |
| 3,514,816 | 6/1970 | Inoue . | |
| 4,060,879 | 12/1977 | Takada . | |
| 4,365,391 | 12/1982 | Chapalain . | |
| 4,408,373 | 10/1983 | Miskowicz | 24/664 |
| 4,458,392 | 7/1984 | Pogharian et al. | 24/664 |
| 4,622,727 | 11/1986 | Wier . | |
| 4,736,497 | 4/1988 | Escaravage | 24/651 X |
| 4,945,617 | 8/1990 | Griffith | 24/633 |
| 5,050,274 | 9/1991 | Staniszewski et al. . | |

FOREIGN PATENT DOCUMENTS

| | | | |
|---|---|---|---|
| 3344794 | 6/1984 | Germany | 24/633 |

*Primary Examiner*—James R. Brittain

*Attorney, Agent, or Firm*—Bell Seltzer Intellectual Property Law Group of Alston & Bird LLP

[57] ABSTRACT

A self-aligning safety belt latch wherein imprecise mating of the tongue member with the buckle housing nonetheless locks the safety belt latch. The tongue member is defined by a continuously arcuate outer configuration and an annular cross-section. The tongue member defines an aperture which is large relative the area of the tongue member. The latching mechanism includes a biased latching mechanism catch extending therefrom. The catch is configured to mate with the tongue aperture and is generally small relative to the tongue aperture. Thus, imprecise mating of the tongue member to the latching mechanism nonetheless effectuates locking of the safety belt latch.

24 Claims, 3 Drawing Sheets

SELF-ALIGNING SEAT BELT BUCKLE

FIELD OF THE INVENTION

The present invention is directed to a safety seat belt latch and, more specifically, to a self-aligning seat belt latch.

BACKGROUND OF THE INVENTION

The effectiveness of safety belts in automobiles has long been established and accepted by the automotive industry and the general public alike. The effectiveness of safety belts is highly publicized by public safety groups to promote awareness and encourage safety belt use. In accord with these efforts, safety belts must be simple to use and be relatively inexpensive.

Conventional seat belts include a lap and shoulder belt with a tongue member for mating with the seat belt latch which may be mounted to the automobile or connected to another belt. Such latches are generally complicated structures and, hence, relatively expensive to install. They also generally include a rectangular tongue member having a rectangular cross-section which is inserted within a mating latch to secure the seat belt. These conventional latches require that the tongue be properly aligned, in all three directions, i.e., x-axis, y-axis, and z-axis, or angular orientation, to properly mate with the buckle. A problem resulting from this arrangement is that precise alignment is required for the latch to properly align with the buckle which often requires two hands, may be difficult to effectuate at night, and may be difficult when wearing bulky clothing, for example. If a user is unable to effectuate the locking mechanism of the seat belt quickly, the user may not try again. Thus, safety belt use may be discouraged rather than encouraged.

For example, U.S. Pat. No. 4,068,879 to Takada is directed to a seat belt buckle for preventing false latching of the seat belt tongue with the seat belt buckle. The seat belt tongue is defined by a discontinuous outer configuration and a central aperture which is small relative to the tongue. Additionally, the tongue according to that patent does not possess an annular cross-section. Thus, the smaller sized aperture and the non-annular tongue is of conventional design and requires precise alignment with the mating buckle in both the horizontal and vertical directions for the seat belt to latch. Further, the latching mechanism according to the prior art patent is a complicated assembly including a multi-functional spring member which biases a latch plate upward, rendering it relatively expensive due to the large number of parts required.

SUMMARY OF THE INVENTION

It is an object of the invention to encourage use of safety belt buckles by providing a belt buckle having a tongue member and a latching mechanism which easily mate even when the initial alignment of the two is imprecise.

It is also an object of the present invention to provide a safety seat belt buckle assembly which is structurally uncomplicated and relatively inexpensive.

The present invention achieves these and other objects and overcomes shortcomings of the prior art by providing a self-aligning safety belt buckle including a tongue member and a latching mechanism having means for releasably receiving the tongue member. The tongue is defined substantially by a shackle and an end portion. The shackle has an annular cross-section and a continuously arcuate outer configuration and defines a catch receiving aperture which is large relative to the area of the shackle. The tongue member mates with a catch extending upwardly from the latching mechanism wherein the latching mechanism is biased in a latching position. The catch is relatively smaller than the aperture of the tongue. A buckle housing houses the latching mechanism and defines a tongue receiving aperture at an end thereof.

Accordingly, the tongue member is inserted through the buckle housing aperture, urging the catch and, hence, the latching mechanism, downward wherein the tongue is inserted a predetermined amount and the catch is urged upward and extends through the catch receiving aperture of the tongue. This thereby locks the safety belt buckle in the latching position. A release is associated with the latching mechanism and, preferably, extends upwardly from the latching mechanism, through an aperture provided on an upper surface of the buckle housing. Pressure applied to the release thereby urges the latching mechanism downward, against its biased position, to release the catch from the tongue aperture. Indeed, imprecise mating of the tongue to the buckle will nonetheless effectively latch the safety belt buckle due to the simplistic assembly of the safety buckle and the mating configuration of the tongue and the catch of the latching mechanism.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

The present invention will now be described more fully in detail with reference to the accompanying drawings, in which preferred embodiments of the invention are shown. This invention should not, however, be construed as limited to the embodiments set forth herein; rather, they are provided so that this disclosure will be thorough and complete and will fully convey the scope of the invention to those skilled in the art.

Figure 1:
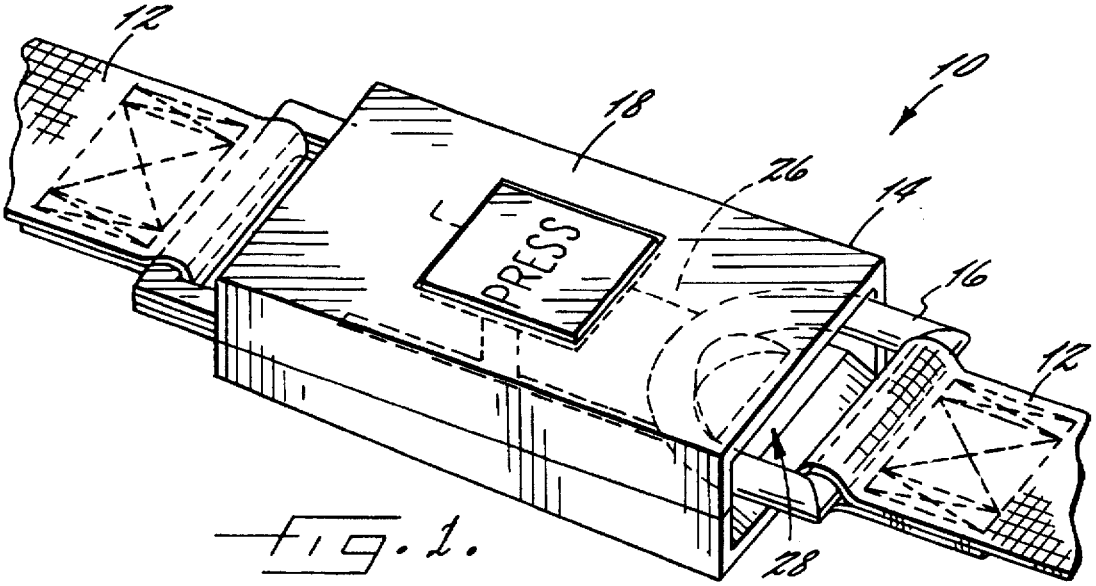
FIG. 1 is a perspective view of the safety belt according to the present invention.

Although the following discussion and the respective illustrations are directed to a safety seat belt such as for an automobile, it is within the scope of the present invention to provide a safety seat belt having infinite applications other than the automotive industry or, for that matter, as a mechanical connector for members other than seat belts. The safety belt 10, illustrated in FIG. 1, includes a seat belt latch, shown generally at 14, and belts 12 which, conventionally, extend from either side of an automobile seat to restrain the user within the seat. Of course, any harnessing arrangement may be provided such as, for example, including a shoulder strap.

The seat belt latch 14 includes a tongue member 16, a buckle housing 18, and a latching mechanism 20. The buckle housing 18 includes an upper portion 22 and a lower portion 24 which, together, define an elongate cavity 26 which, preferably, extends substantially in the same plane as the tongue member 16 or, as shown, in a horizontal plane. The buckle housing 18 also defines, on one end thereof, an aperture 28 which extends perpendicular to the plane of the elongate cavity 26. As shown, the aperture 28 extends substantially across the width of the buckle housing 18.

The tongue member 16 is illustrated as having a "D-shaped" configuration defined by a shackle 29 and an end portion 36. The area of the shackle 29 is defined between an outer margin 30 and an inner margin 32. A central aperture 34 is defined by the shackle 29 and the end portion 36 and has an area which is large relative to the overall size of the shackle 29. The horizontally extending end portion 36 of the tongue member 16 is configured to cooperate with the belt 12 as illustrated in the various figures. The shackle 29 of the tongue member 16 has an annular cross-section as best illustrated in FIG. 2A.

Preferably, the tongue aperture 34 has an area which is at least two times greater than an area of the shackle 29 defined by the distance between the outer 30 and the inner 32 margins of the tongue member 16. Accordingly, the portion of the tongue member 16 which is inserted through the aperture 28 of the buckle housing 18 is continuously arcuate both in its outer margin 30 and in cross-section. Accordingly, precise alignment of the tongue member 16 into the aperture 28 is unnecessary.

Figure 6:
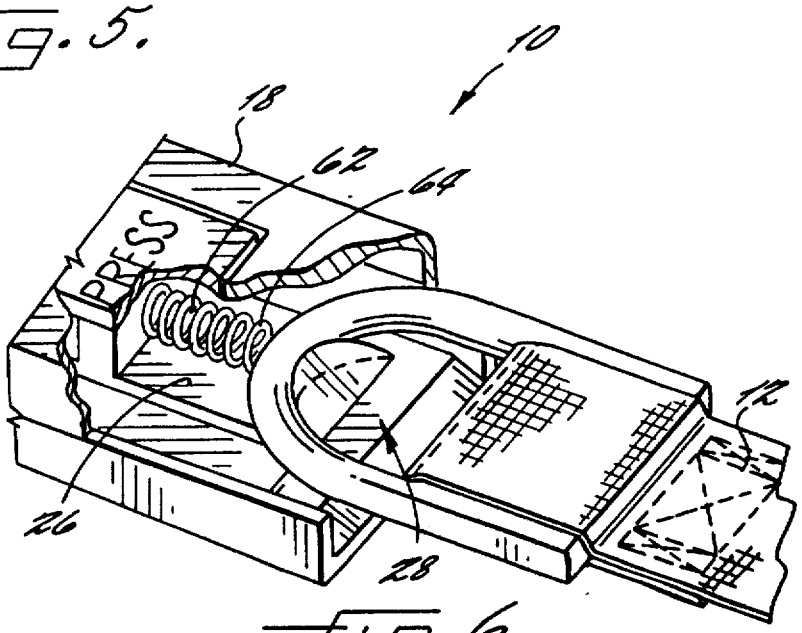
FIG. 6 is a partially broken away perspective view of the seat belt latch according to a third embodiment of the present invention.

The vertical height of the aperture 28 is greater than the thickness of the tongue member 16 and is also wider than the width of the tongue member 16. Preferably, the aperture 28 is at least an eighth of an inch (⅛") greater in the horizontal and the vertical directions than the thickness and width of the tongue member 16. As illustrated, the belt 12 is wrapped around the horizontal end portion 36 of the tongue member 16 and the two layers of the belt 12 are sewn together. Of course, any means of attaching a belt would not constitute a departure from the scope of the present invention. While the end portion 36 is shown as an elongate rod-like member, any solid form may be utilized. For example, FIG. 6 illustrates an alternative embodiment wherein the end portion is rectangular and a substantial portion is not received within the buckle housing 18 when the tongue member 16 is in the latching position.

Figure 2:
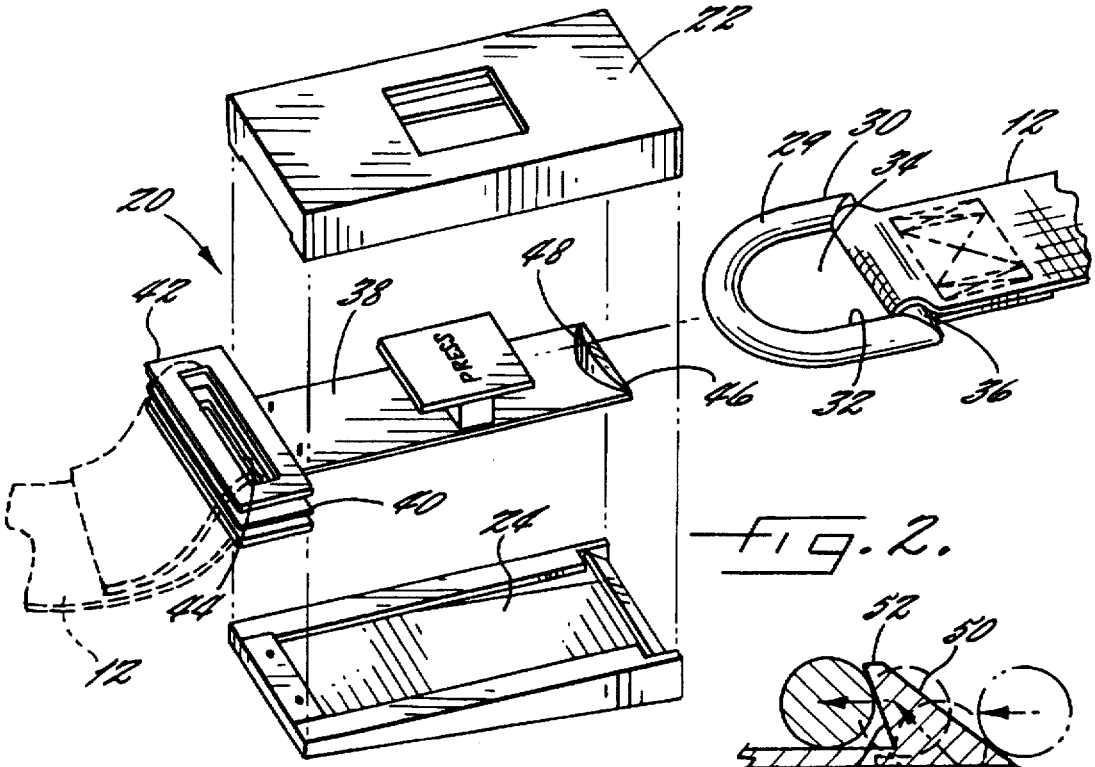
FIG. 2 is an exploded of the safety belt latch.
Figure 2A:
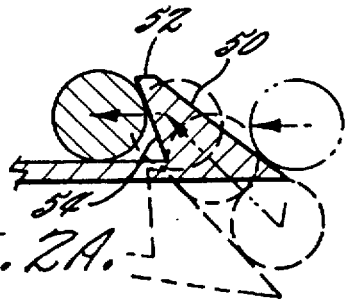
FIG. 2A is a cross-sectional view of a portion of the latching mechanism of the safety belt latch.
Figure 3:
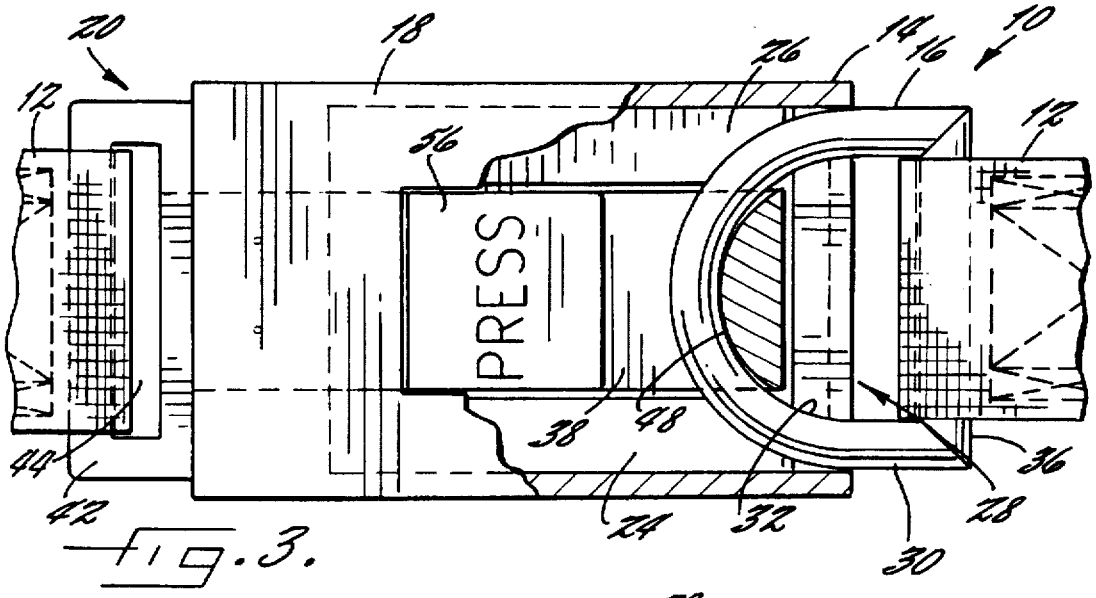
FIG. 3 is a partially broken away top plan view of the safety belt latch.

The latching mechanism 20 is best illustrated in FIGS. 2 and 3. The latching mechanism 20 is illustrated as having a "T-shaped" configuration defined by an elongate portion 38 and a distal portion 40. Positioned on either side of the distal portion 40 are threadable members 42. The threadable members 42 and the distal portion 40 of the latching mechanism 20 each define an elongate aperture 44 through which the belt 12 may be threaded.

Positioned adjacent a proximal end 46 of the latching mechanism 20 is a catch 48. The catch 48 is configured to cooperate with the tongue aperture 34 of the tongue member 16. Preferably, and as illustrated, the catch 48 is relatively small compared to the area of the tongue aperture 34 defined by the inner margin 32 of the tongue member 16. As illustrated in the various figures, the catch 48 is defined by a semi-circular outer configuration. In profile, as illustrated in FIG. 2A, the catch 48 includes a chamfered surface 50 for cooperating with the insertion of the tongue member 16 as described in more detail below. The chamfered surface 50 extends in a plane at an acute angle to the elongate latching mechanism 20. The chamfered surface intersects, at its upper end, with a horizontally extending portion 52 of the catch 48. The rear side 54 of the catch 48 is configured to provide an abutting surface for the tongue member 16 when the seat belt latch 14 is in its locked position. As illustrated in FIG. 2A, the lock position is illustrated in solid lines whereas the unlocked position is illustrated in dotted lines.

Figure 4A:
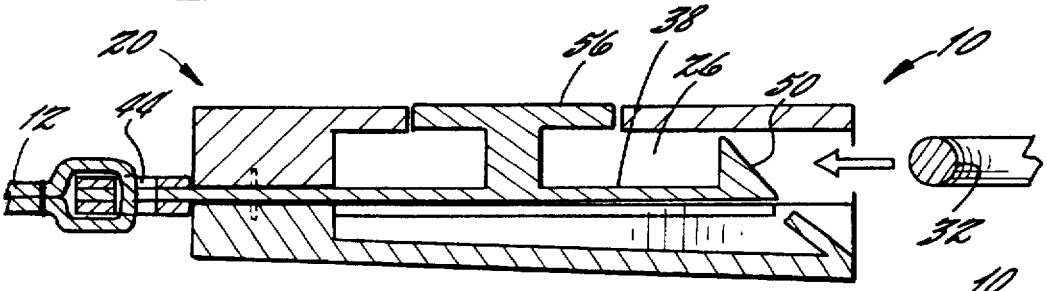
FIGS. 4A–4D are cross-sectional views of the insertion of the tongue member into the buckle housing showing the sequential process thereof.
Figure 4B:
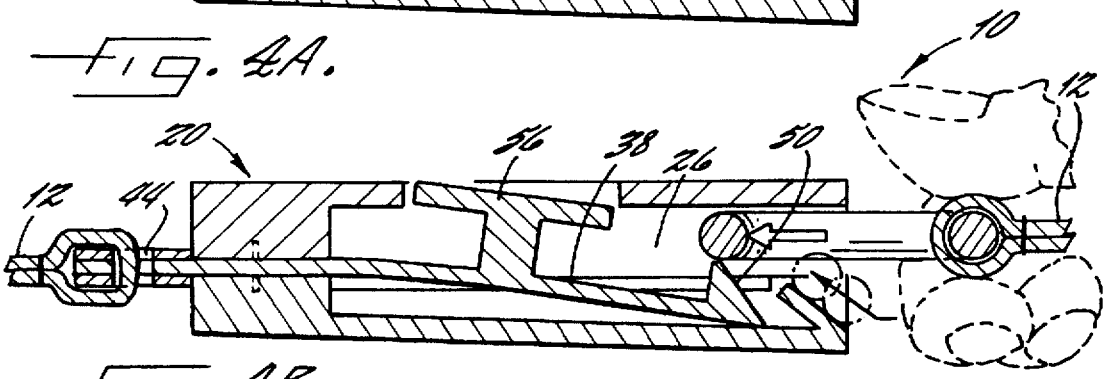
Figure 4C:
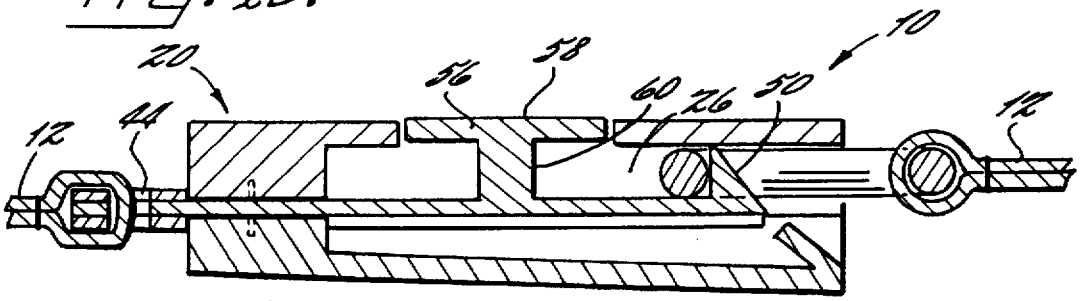

The operation of the present invention will now be described in detail with reference to FIGS. 2A and 4A through 4D, particularly. The tongue member 16, or at least the shackle 29, having the relatively large tongue aperture 34 is inserted into the aperture 28 of the buckle housing 18 after the latching mechanism 20 assumes its original position. Accordingly, the tongue member 16 contacts the chamfered surface 50 of the catch 48 (as illustrated in FIG. 4A) wherein the latching mechanism 20 is urged downward, against its biased position wherein the tongue member 16 traverses across the horizontal portion 52 of the catch 48 (FIG. 4B) and seats against the rear surface 54 of the catch (FIG. 4C). FIG. 4C illustrates the locked position of the seat belt latch 14.

Figure 4D:
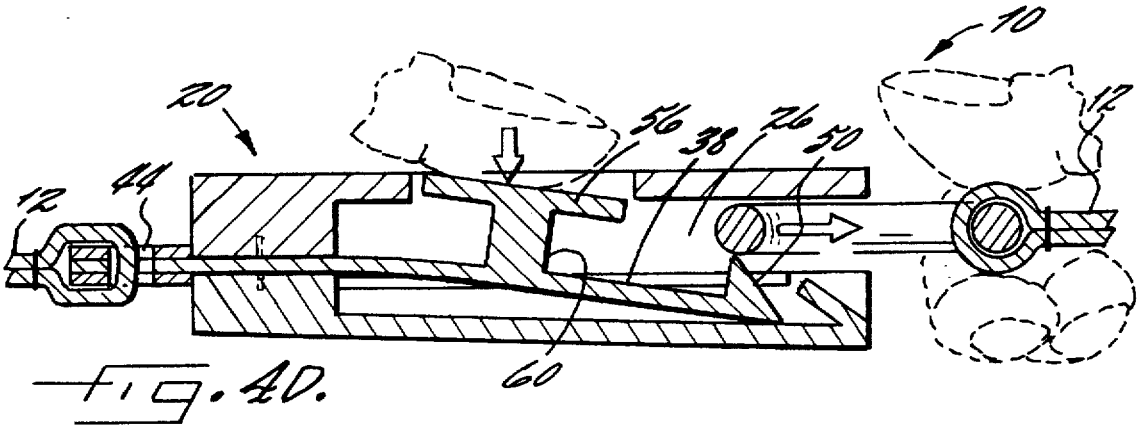

In a preferred embodiment, a release 56 is operatively associated with the latching mechanism 20, and more specifically, with the elongate portion 38 thereof. As stated above, the latching mechanism 16 is preferably biased in a substantially horizontal position. As illustrated, the release 56 extends perpendicular to the elongate portion 38 of the latching mechanism 20 and is defined, in cross section, as a "T-shaped" member. Accordingly, the release 56 includes a horizontally extending portion 58 defining an actuator and a vertical portion 60 extending from the actuator 58 to the elongate portion 38 of the latching mechanism 16. Accordingly, pressure, such as by a user's finger, may be applied to the actuator 58 wherein the latching mechanism 20 is urged downward, thereby also urging the catch 48 downward. Accordingly, the tongue member 16 is free to be released from the buckle housing 18 as shown in FIG. 4D.

In an alternative embodiment, as illustrated in FIG. 6, an ejector 62 may be provided. As illustrated, the ejector 62 is in the form of a spring which extends from the vertical portion 60 of the release 56 and which has a free proximal end 64 which contacts the shackle 29 of the tongue member 16. Accordingly, when pressure is applied to the release 56 and the catch 48 is urged downward, the ejector 62 urges the shackle 29 through the buckle housing aperture 28 wherein it is automatically released from the buckle housing 18.

Figure 5:
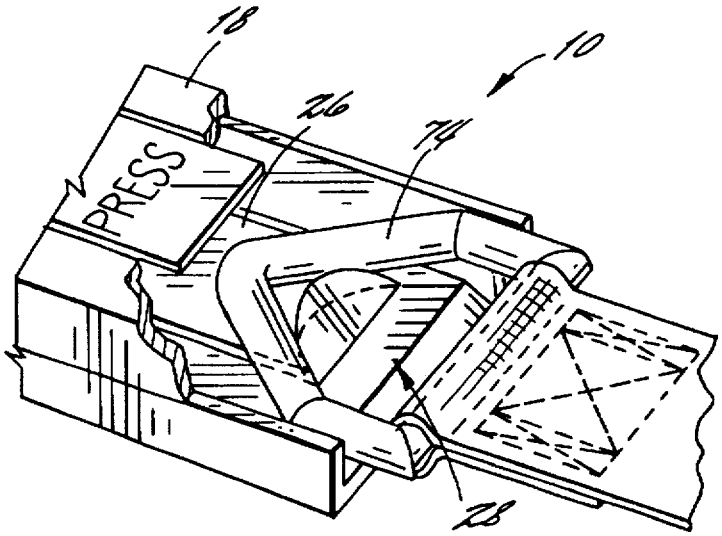
FIG. 5 is a partially broken away top perspective view of a seat belt latch having a tongue member according to a second embodiment of the present invention.

FIG. 5 illustrates another embodiment of the present invention wherein the tongue member is differently configured. As in the previous embodiment, the tongue member 66 according to this embodiment has an annular cross-section and a continuously arcuate shackle 69 and an end portion 71. Also like the other embodiment, the tongue member 66 has a relatively large central aperture 68. However, this embodiment differs in that the outer margin 70 and the inner margin 72 of the shackle 69 are differently configured. As illustrated, the outer and inner margins 70 and 72 have a complex geometric configuration defined substantially by a "v-shaped" distal portion 74 and proximal portion 76 resembling half of a square. Accordingly, this embodiment, too, is easily aligned with the buckle housing 18 irrespective of its initial alignment both in the vertical and horizontal directions with the buckle housing aperture 28.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A self-aligning safety belt buckle comprising:

a tongue member defined at least in part by a shackle having an inner and outer margin and an end portion defining a central aperture which is greater in area than an area of said shackle defined between said margins, said end portion configured to cooperate with a belt;

an elongate, substantially planar latching mechanism moveable between a latching and an unlatching position and having a distal end configured to cooperate with a belt and a proximal end having a catch extending therefrom, said catch being biased towards the latching position and configured to be received within said central aperture of said tongue member; and a buckle housing defining a cavity for receiving said latching mechanism and having a tongue receiving aperture defined by an end of said buckle housing, said tongue receiving aperture being configured to receive said tongue member into said cavity wherein said tongue member is inserted into said tongue receiving aperture and is releasably secured with said catch in said latching position.

2. A self-aligning safety buckle according to claim 1 wherein said cavity is elongate and extends substantially in a plane.

3. A self-aligning safety buckle according to claim 1 wherein said buckle housing substantially encloses said latching mechanism.

4. A self-aligning safety buckle according to claim 1 wherein said buckle housing substantially encloses said shackle in said latching position.

5. A self-aligning safety buckle according to claim 1 wherein said shackle has an annular cross-section.

6. A self-aligning safety buckle according to claim 1 wherein said elongate latching mechanism further comprises a release operatively associated with said member wherein said release urges said tongue member towards said unlatching position to thereby release said catch from said tongue member.

7. A self-aligning safety buckle according to claim 1 wherein said area of said central aperture of said tongue member is at least about two times said area of said tongue member defined between said inner and outer margins thereof.

8. A self-aligning safety buckle according to claim 1 wherein said catch extends upwardly from said latching mechanism and includes a chamfered surface portion facing said tongue receiving aperture wherein said tongue contacts said chamfered portion when it is inserted through said tongue receiving aperture.

9. A self-aligning safety buckle according to claim 1 wherein said shackle is semi-circular.

10. A self-aligning safety buckle according to claim 1 wherein said shackle includes a V-shaped portion opposite said end portion cooperating with said belt.

11. A self-aligning safety buckle according to claim 1 further comprising an ejection spring mounted within said buckle housing cavity and being positioned so as to bias said tongue member in said unlatching position.

12. A self-aligning safety buckle according to claim 11 wherein said ejection spring is mounted at a distal end to said latching mechanism and wherein a proximal end of said ejection spring bears against said tongue member when said safety belt is in said latching position.

13. A self-aligning safety buckle according to claim 12 wherein said distal end of said ejection spring is mounted to a release extending from said latching mechanism.

14. A self-aligning safety belt buckle according to claim 1 wherein said latching mechanism is defined by an elongate portion and a distal portion which define a generally T-shaped configuration and said catch is supported upon said elongate portion.

15. A self-aligning safety belt buckle comprising:

a tongue member defining an aperture and having an end portion configured to cooperate with a belt;

an elongate, substantially planar latching mechanism movable between a latching and an unlatching position and having a distal end configured to cooperate with a belt and a proximal end having a catch extending therefrom, said catch being biased in said latching position and configured to be received with said aperture of said tongue member, and a release extending upwardly from said latching mechanism between said proximal and distal ends thereof; and a buckle housing defining a cavity for receiving said elongate latching mechanism and a tongue receiving aperture defined by an end of said buckle housing, said tongue receiving aperture being configured to receive said tongue into said cavity wherein said tongue is inserted into said tongue receiving aperture and is releasably secured with said catch in said latching position wherein pressure applied to said release urges said latching mechanism to said unlatching position.

16. A self-aligning safety buckle according to claim 15 wherein said release extends upwardly from said latching mechanism between said proximal and distal ends thereof.

17. A self-aligning safety buckle according to claim 16 wherein said buckle housing defines a release aperture wherein said release extends from said latching mechanism and at least a portion thereof extends through said aperture.

18. A self-aligning safety buckle according to claim 15 wherein said catch is defined by a chamfered surface facing said proximal end of said latching mechanism and an opposing surface facing said distal end of said latching mechanism, said opposing surface being configured to retain said tongue member in said latching position.

19. A self-aligning safety belt buckle comprising:

a tongue member having an end portion configured to cooperate with a belt and defining a central aperture;

an elongate, substantially planar latching mechanism moveable between a latching and an unlatching position having a distal end configured to cooperate with a belt, a proximal end having a catch extending upwardly therefrom, and a release extending upwardly from said latching mechanism between said proximal and distal ends, said release defined at least in part by an actuator and a vertical portion extending substantially perpendicular to a central portion of said latching mechanism for mounting said actuator to said substantially planar latching mechanism, said catch being biased in a latching position and being configured to be received with said central aperture of said tongue member; and a buckle housing defining an elongate cavity for receiving said elongate latching mechanism and having a tongue receiving aperture defined by an end of said buckle housing wherein said tongue receiving aperture is configured to receive said tongue member and said catch cooperates with said tongue aperture to releasably secure said tongue member in said latching position wherein pressure applied to said release urges said tongue member towards said unlatching position to thereby release said catch from said latching position.

20. A self-aligning safety belt buckle according to claim 19 wherein said latching mechanism is substantially planar.

21. A self-aligning safety belt buckle according to claim 19 wherein said release is substantially T-shaped in cross-section.

22. A self-aligning safety belt buckle according to claim 19 wherein said tongue member includes a shackle having an inner and outer margin and said aperture is greater in area than an area of said shackle defined between said margins.

23. A self-aligning safety belt buckle comprising:

a tongue member defining an aperture and having an end portion configured to cooperate with a belt;

an elongate latching mechanism moveable between a latching and an unlatching position and having a distal end configured to cooperate with a belt and a proximal end having a catch extending therefrom, said catch being biased towards the latching position and configured to be received within said aperture of said tongue member, said latching member having a release operatively associated therewith;

a buckle housing defining a cavity for receiving said latching mechanism and having a tongue receiving aperture defined by an end of said buckle housing, said tongue receiving aperture being configured to receive said tongue member into said cavity wherein said tongue member is inserted into said tongue receiving aperture and is releasably secured with said catch in said latching position; and an ejection spring mounted within said buckle housing cavity and being positioned so as to bias said tongue member in said unlatching position wherein a distal end of said spring is mounted to said release and a proximal end of said ejection spring bears against said tongue member when said safety belt is in said latching position.

24. A self-aligning safety belt buckle according to claim 23 wherein said tongue member includes a shackle having an inner and outer margin and said aperture is greater in area than an area of said shackle defined between said margins.

* * * * *